US006670750B2

(12) United States Patent
Hanahara et al.

(10) Patent No.: US 6,670,750 B2
(45) Date of Patent: Dec. 30, 2003

(54) LUMINOUS EL SHEET HAVING A DOMED DIAPHRAGM AND A SWITCH EMPLOYING THE EL SHEET

(75) Inventors: Tetsuro Hanahara, Fukui (JP); Shinji Okuma, Fukui (JP); Takayuki Ishikawa, Fukui (JP); Koichi Santo, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/979,163

(22) PCT Filed: Jul. 5, 2001

(86) PCT No.: PCT/JP01/05834

§ 371 (c)(1),
(2), (4) Date: Mar. 8, 2002

(87) PCT Pub. No.: WO02/05302

PCT Pub. Date: Jan. 17, 2002

(65) Prior Publication Data

US 2003/0006701 A1 Jan. 9, 2003

(30) Foreign Application Priority Data

Jul. 7, 2000 (JP) ..... 2000-206468

(51) Int. Cl.[7] ..... H01H 1/10; H01J 1/62; H05B 33/00

(52) U.S. Cl. ..... 313/511; 313/506; 313/512; 200/513

(58) Field of Search ..... 313/506, 509, 313/511, 512; 200/512, 513, 310, 314, 514

(56) References Cited

U.S. PATENT DOCUMENTS

| | | | | | |
|---|---|---|---|---|---|
| 5,871,088 | A | * | 2/1999 | Tanabe | 200/514 |
| 5,901,834 | A | * | 5/1999 | Inubushi et al. | 200/314 |
| 5,950,808 | A | * | 9/1999 | Tanabe et al. | 200/314 |

FOREIGN PATENT DOCUMENTS

| | | |
|---|---|---|
| EP | 0 818 793 | 1/1998 |
| EP | 0 847 066 | 6/1998 |
| JP | 11-39983 | 2/1999 |

* cited by examiner

*Primary Examiner*—Nimeshkumar D. Patel
*Assistant Examiner*—Karabi Guharay
(74) *Attorney, Agent, or Firm*—Wenderoth, Lind & Ponack, L.L.P.

(57) ABSTRACT

An EL sheet is used as a back light of an operating section of various electronic apparatuses. The EL sheet generates a stable click feel and is easily processed. A switch employing the EL sheet is also provided. An EL element layer is not formed at a bent section or its vicinity around a root section of a diaphragm. Only conductive patterns, which are coupled to a light-transmissible electrode layer and a back electrode layer respectively, are formed there. Instead of the conductive patterns, insulating film can be exposed there.

10 Claims, 6 Drawing Sheets

LUMINOUS EL SHEET HAVING A DOMED DIAPHRAGM AND A SWITCH EMPLOYING THE EL SHEET

TECHNICAL FIELD

The present invention relates to an EL sheet employed as a back light in an operating section of various electronic apparatuses, and to a switch employing the EL sheet.

BACKGROUND ART

Electronic apparatuses, as being diversified recently, includes a switch-key to be identified and operable even in a dark place. The switch-key includes a back light disposed at a rear part of an operating section. Many of the back lights employ EL sheets. A switch including the conventional EL sheet discussed above will be described hereinafter with reference to FIG. 7, in which dimensions in a thickness direction are enlarged for better understanding.

FIG. 7 shows a lateral sectional view of the switch employing an EL sheet. Light-transmissible insulating film 1 made of, e.g., polyethylene terephtalate has domed diaphragm 2, which swells upward, formed at a given place. Beneath the entire lower face of film 1, light-transmissible electrode layer 3A, made of tin indium oxide, is formed by a spattering or an electron beam method.

Luminous layer 3B, dielectric layer 3C, back electrode layer 3D, and insulating layer 3E are laid one after another beneath layer 3A by printing beneath layer 3A except bent section 2A around the root of diaphragm 2, so that EL element layer 3, as a whole, may be constructed. Luminance layer 3B includes high dielectric resin, made of fluoro rubber or cyano-system resin in which zinc sulfide, which is a base material for light emission, is dispersed. Dielectric layer 3C includes high dielectric resin in which barium titante is dispersed. Back electrode layer 3D is made of silver or carbon resin system. Insulating layer 3E is made of epoxy resin or polyester resin.

Beneath EL element layer 3, formed on the lower face of diaphragm 2, a movable contact 4 is printed, so that EL sheet 5, as a whole, may be constructed. Movable contact 4 is made of epoxy resin or polyester resin in which conductive particles such as silver or carbon are dispersed.

Circuit board 6 made of an insulating film such as polyethylene terephtalate is disposed under EL sheet 5, and a pair of fixed contacts 6A—facing movable contact 4 with a given clearance—are disposed on the upper face of board 6. Plural wiring patterns (not shown) are coupled to fixed contacts 6, so that a switch as a whole may be constructed.

Beneath insulating film 1, having an entire lower face covered with light-transmissible electrode layer 3A, EL element layer 3, which includes luminous layer 3B, dielectric layer 3C, back electrode layer 3D and insulating layer 3E, is printed. Movable contact 4 is also printed on the top of that. Then diaphragm 2 is formed using a mold, so that EL sheet 5 may be completed. EL sheet 5 is bonded to circuit board 6 with adhesive or by thermal bonding so that the switch may be completed.

The switch is mounted to an operating section of an electronic apparatus, and an alternating current (AC) voltage from a circuit of the apparatus is applied between light-transmissible electrode layer 3A and back electrode layer 3D of EL sheet 5, so that luminous layer 3B may emit light. The light illuminates the operating section of the apparatus from the back of the operating section, and thus a user can identify and operate the operating section easily even in a dark place.

Diaphragm 2 is depressed from above the diaphragm through, e.g., a key-button, then diaphragm 2 is bowed on a fulcrum, i.e., bent section 2A or its vicinity with a click feel, and thereby, movable contact 4 moves downward to contact with fixed contacts 6A. Movable contact 4 thus contacts electrically with fixed contacts 6A. When the depression is released, diaphragm 2 is restored to the status shown in FIG. 7 by resilient restoring force of the diaphragm.

The conventional EL sheet in the switch includes light-transmissible electrode layer 3A made of metallic hard film formed beneath the entire face of insulating film 1. This structure degrades the click feel and the flexibility of diaphragm 2 during operation. Thus, light-transmissible electrode layer 3A may crack when diaphragm 2 is formed or depressed repeatedly. Further, the depressing force through diaphragm 2 tends to change.

SUMMARY OF THE INVENTION

An EL sheet generates a stable click feel during an operation and is easy to be processed. A switch employs the EL sheet. The EL sheet includes the following elements:

(a) a light-transmissible insulating film having a domed diaphragm swelling upward;

(b) an EL element layer including a light-transmissible electrode layer, a luminous layer, a dielectric layer, and a back electrode layer laminated beneath the insulating film in this order except at a bent section and its vicinity around the root of the diaphragm;

(c) a first conductive pattern coupled to the light-transmissible electrode layer and formed beneath the insulating film; and (d) a second conductive pattern being coupled to the back electrode layer and formed beneath the insulating film.

The switch includes the EL sheet and contacts being disposed under the diaphragm to resiliently and electrically contact each other.

DESCRIPTION OF THE PREFERRED EMBODIMENT

Figure 1:
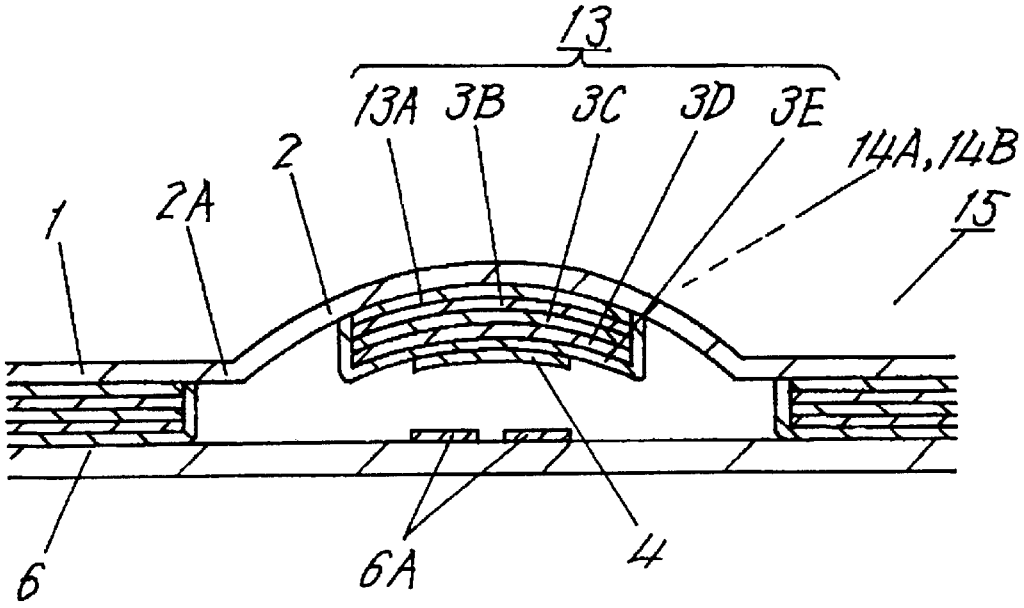
FIG. 1 is a lateral sectional view of a switch employing an EL sheet in accordance with a first exemplary embodiment of the present invention.

Exemplary embodiments of the present invention will be explained hereinafter with reference to the accompanying drawings, FIG. 1 through FIG. 6. For easy understanding, the dimensions in a thickness direction are enlarged. Elements similar to those used in the background art are denoted by the same reference numerals, and detailed descriptions thereof are thus omitted here.

Exemplary Embodiment 1

Figure 2:
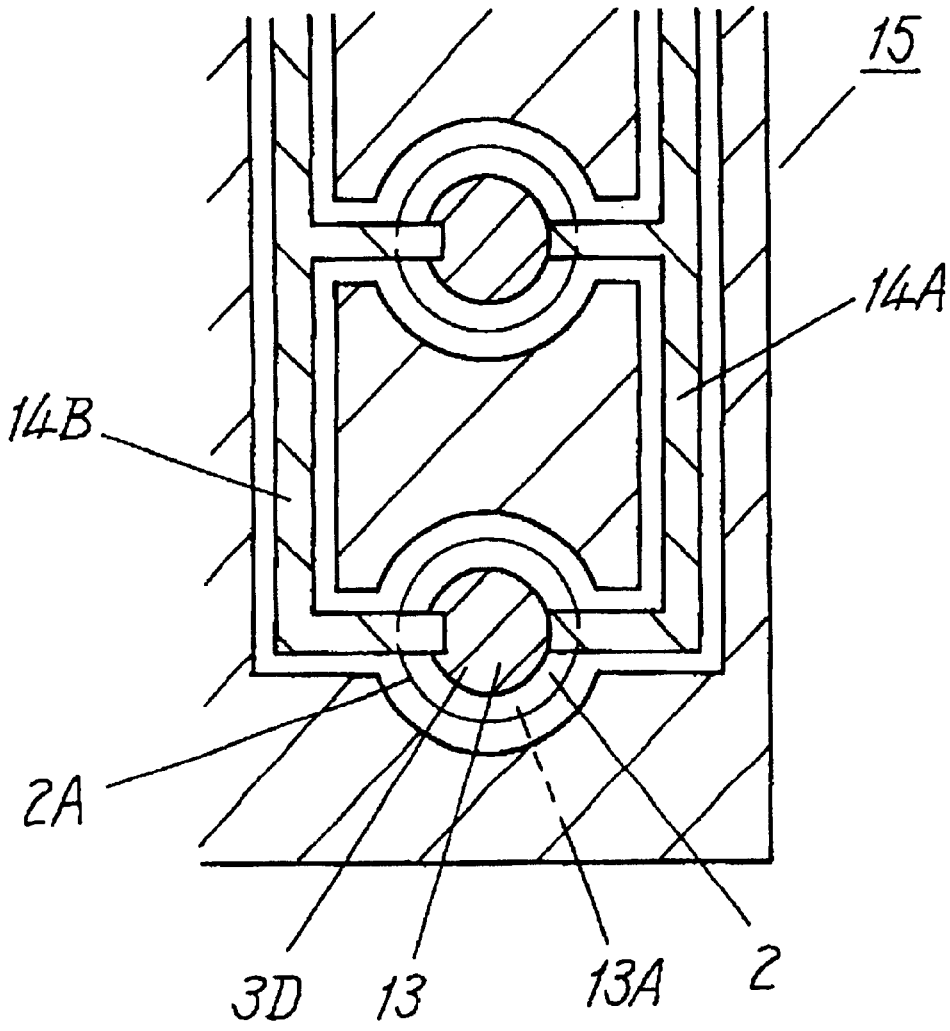
FIG. 2 is a cross sectional view of the EL sheet.

FIG. 1 is a lateral sectional view of a switch employing an EL sheet in accordance with a first exemplary embodiment of the present invention. FIG. 2 is a cross sectional view of the EL sheet. Light-transmissible insulating film 1, made of, e.g., polyethylene terephtalate, swells upward at a given place, so that domed diaphragm 2 may be formed. Light-transmissible electrode layer 13A is printed beneath diaphragm 2 and the flat section of insulating film 1, except for bent section 2A and its vicinity around the root of diaphragm 2. Light-transmissible electrode layer 13A is made of light-transmissible resin such as phenoxy resin, epoxy resin, or fluoro rubber, in which conductive particles such as tin indium oxide, tin oxide or indium oxide are dispersed. Beneath layer 13A, luminous layer 3B, dielectric layer 3C, back electrode layer 3D and insulating layer 3E are formed by printing one after another in this order, so that EL element layer 13, as a whole, may be constructed. Luminance layer 3B includes high dielectric resin, made of fluoro rubber or cyano-system resin, in which zinc sulfide, which is a base material for light emission, is dispersed. Dielectric layer 3C includes high dielectric resin, in which barium titante is dispersed. Back electrode layer 3D is made of a silver or carbon resin system. Insulating layer 3E is made of epoxy resin or polyester resin.

Further, conductive patterns 14A and 14B have respective first ends coupled to layer 13A and layer 3D, and run through bent section 2A. Second ends of conductive patterns 14A and 14B extend to a tail section (not shown) protruding from the outward appearance. Conductive patterns 14A and 14B are formed by printing epoxy resin or polyester resin in which silver or carbon is dispersed.

Beneath EL element layer 13 formed on the lower face of diaphragm 2, movable contact 4 is printed, so that EL sheet 15, as a whole, may be constructed. Movable contact 4 is made of epoxy resin or polyester resin, in which silver or carbon is dispersed.

Circuit board 6 made of insulating film such as polyethylene terephtalate is disposed under EL sheet 15, and a pair of fixed contacts 6A, which face movable contact 4 via a given clearance, are disposed on the upper face of board 6. Plural wiring patterns (not shown) are coupled to fixed contacts 6, so that a switch as a whole may be constructed. EL sheet 15 is bonded to circuit board 6 with adhesive or by thermal bonding, so that the switch may be completed.

In the structure discussed above, the switch is mounted to an operating section of an electronic apparatus, and an AC voltage is supplied from a circuit of the apparatus to conductive patterns 14A and 14B coupled respectively to light-transmissible electrode layer 13A and back electrode layer 3D of EL sheet 15. The voltage causes layer 3B to emit light. The light illuminates the operating section of the apparatus from behind the operating section, and a user can thus identify and operate the operating section easily even in a dark place.

Diaphragm 2. is depressed from above the diaphragm through a key-button, then diaphragm 2 is bowed with a click feel on a fulcrum, i.e., bent section 2A or its vicinity, where only conductive patterns 14A and 14B are formed, thereby moving movable contact 4 downward to contact with fixed contact 6A. Movable contact 4 thus contacts electrically with fixed contact 6A. When the depression is released, diaphragm 2 is restored to the status shown in FIG. 1 by the resilient restoring force of the diaphragm.

According to the first embodiment, EL element layer 13 is not formed at bent section 2A and its vicinity which functions as a fulcrum, where diaphragm 2 is bowed by a depression. But only conductive patterns 14A and 14B, which are flexible, are formed in this area. Thus, the sheet generates a stable click feel during operation, and has diaphragm 2 which is easy to be processed. As a result, an EL sheet, and a switch employing the EL sheet with a stable click feel, are obtainable.

Light-transmissible electrode layer 13A is formed by printing flexible light-transmissible resin in which conductive particles are dispersed, so that the resin may increase the flexibility of diaphragm as a whole. Thus, the switch generates a better click feel during operation.

Since movable contact 4 is formed on the lower face of the EL element layer disposed beneath diaphragm 2, the switch can be constructed easily by just combining circuit board 6 including fixed contacts 6A with EL sheet 15.

Figure 3:
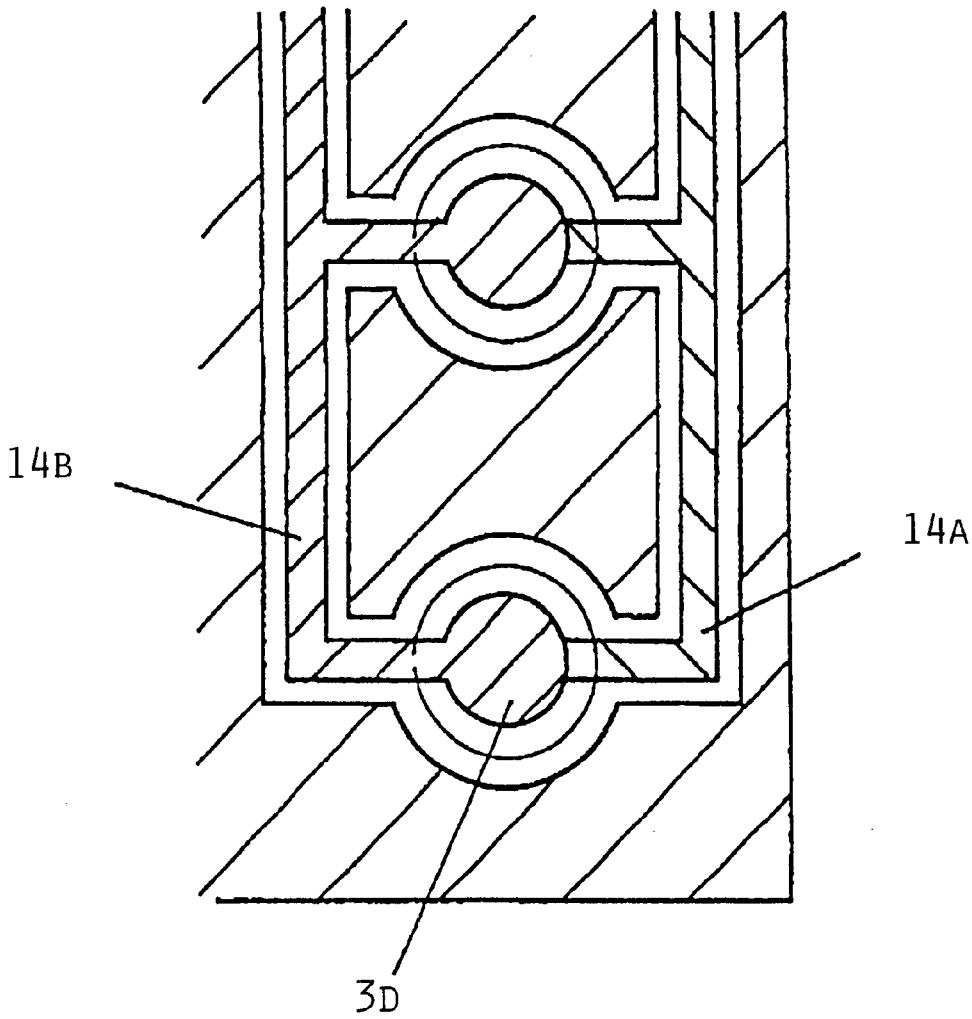
FIG. 3 is a cross sectional view of the EL sheet.

As shown in the cross sectional view of FIG. 3, respective conductive patterns can be formed integrally with layer 13A and layer 3D. In this case, a conductive pattern coupled to layer 13A and the other conductive pattern coupled to layer 3D can be printed simultaneously. Thus the number of printings to form the EL element layer can be reduced, which lowers the cost of the EL sheet.

Figure 4:
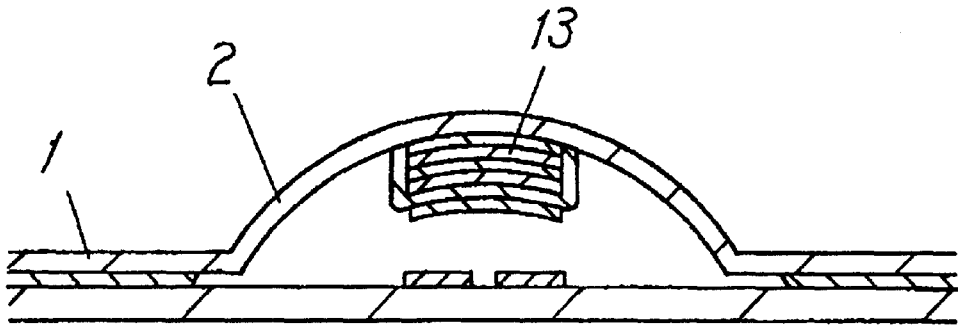
FIG. 4 is a lateral sectional view of the EL sheet.
Figure 5:
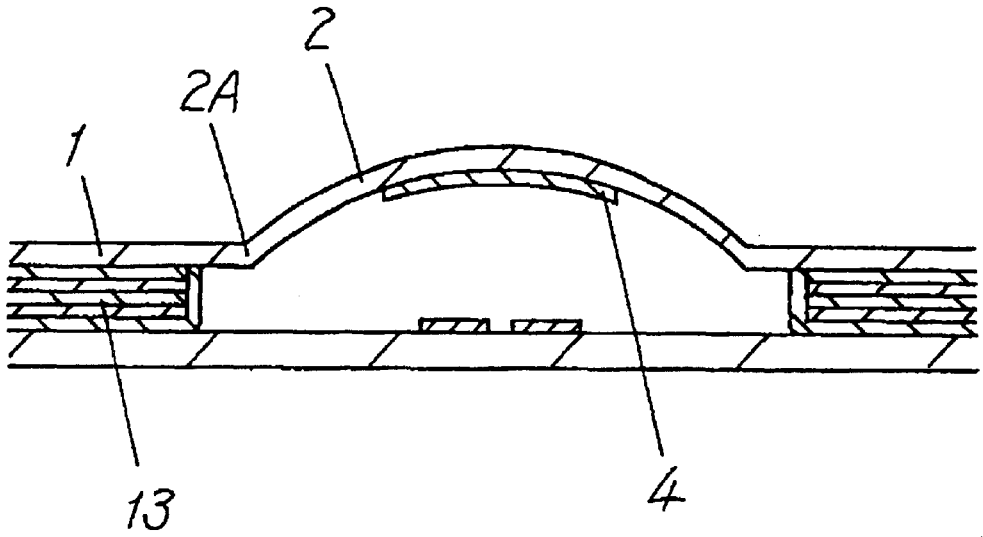
FIG. 5 is a lateral sectional view of the EL sheet.

In the above description, EL element layer 13 is formed beneath diaphragm 2 and a flat section of insulating film 1 except at bent section 2A and its vicinity around the root of diaphragm 2. However, as shown in FIG. 4, EL element layer 13 can be formed only beneath diaphragm 2. Further, as shown in FIG. 5, EL element layer 13 can be formed only beneath the flat section of insulating film 1, and only movable contact 4 can remain beneath diaphragm 2. In these cases, the conductive patterns are not formed at bent section 2A or its vicinity functioning as a fulcrum around the root of diaphragm 2, and insulating film 1 exposes itself, thereby further increasing the flexibility. As a result, a more stable and moderate feeling can be obtained.

Exemplary Embodiment 2

Figure 6:
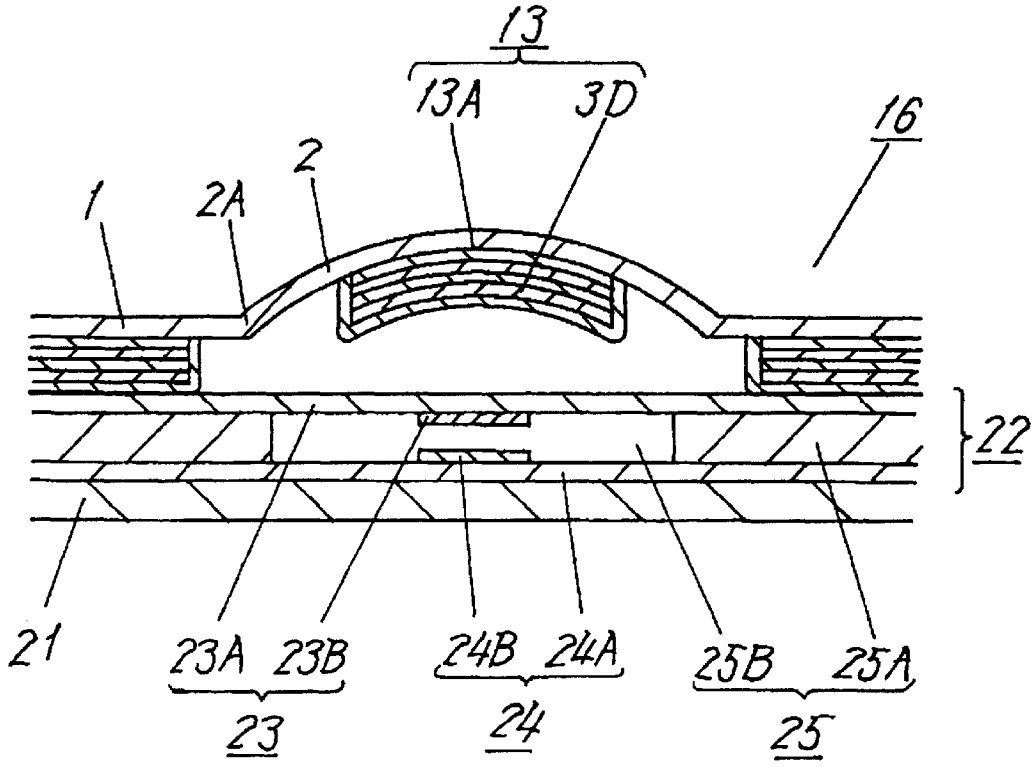
FIG. 6 is a lateral sectional view of a switch employing an EL sheet in accordance with a second exemplary embodiment of the present invention.
Figure 7:
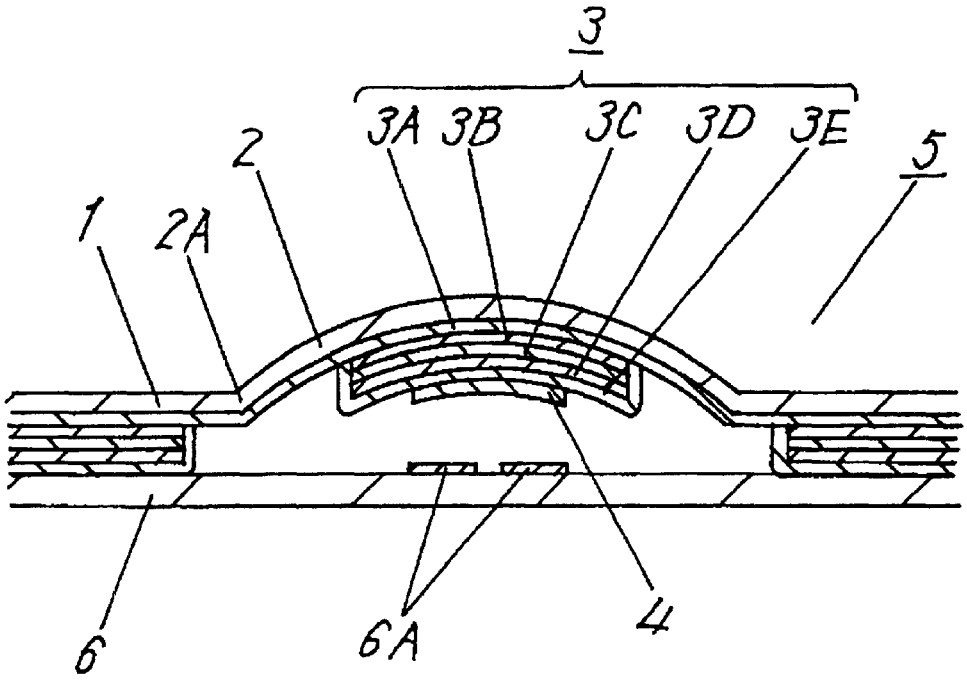
FIG. 7 is a lateral sectional view of a switch employing a conventional EL sheet.

The elements similar to those in the first embodiment are denoted by the same reference numerals, and the detailed descriptions thereof are thus omitted here. FIG. 6 is a lateral sectional view of a switch employing an EL sheet in accordance with a second exemplary embodiment of the present invention. Diaphragm 2 is formed in insulating film 1. EL element layer 13 is formed beneath diaphragm 2 and insulating film 1 except at bent section 2A and its vicinity around the root of diaphragm 2. This structure is the same as that of embodiment 1. Conductive patterns are respectively coupled to light-transmissible electrode layer 13A and back electrode layer 3D of EL element layer 13, similar to embodiment 1.

EL sheet 16 has no movable contact formed beneath EL element layer 13. Beneath EL sheet 16, is disposed switch contact 22 of a membrane type being placed on insulating substrate 21, and thereby forming a switch. This membrane switch contact 22 includes upper sheet 23 and lower sheet 24. Upper sheet 23 includes flexible insulating film 23A and movable contact 23B formed beneath film 23A under the center of diaphragm 2. Lower sheet 24 includes insulating film 24A and fixed contact 24B, which faces movable contact 23B, formed on film 24A. Movable contact 23B is formed on upper sheet 23 and made of epoxy resin or polyester resin in which silver or carbon is dispersed.

Upper sheet 23 is bonded to lower sheet 24 with adhesive (not shown) applied on both faces of an insulating film 25A, which is a part of a spacer 25. Between movable contact 23B and fixed contact 24B, a given clearance is provided at opening 25B.

The switch is mounted to an operating section of an electronic apparatus, and an alternating current (AC) voltage is applied from a circuit of the electric apparatus between light-transmissible electrode layer 13A and back electrode layer 3D, so that EL sheet 16 may emit light similarly to the first embodiment.

Diaphragm 2 is depressed from above the diaphragm through a key-button, then diaphragm 2 is bowed with a click feel on a fulcrum, i.e., bent section 2A and its vicinity, similarly to the first embodiment. At this moment, the lower face of diaphragm 2 is pushed to upper sheet 23 via EL element layer 13, and upper sheet 23 of membrane-switch contact 22 bows downward at opening 25B. Movable contact 23B is thus moved downward to contact with fixed contact 24B, thereby making electrical contact between movable contact 23B and fixed contact 24B. When the depression is released, diaphragm 2 is restored to the status shown in FIG. 6 by the resilient restoring force of the diaphragm.

According to the second embodiment, switch contact 22, which turns on and off by depression, is disposed under diaphragm 2 of EL sheet 16. Thus, a switch generating a stable click feel and having excellent flexibility can be provided.

Instead of membrane-switch contact 22, an independent push switch can be combined with EL sheet 16, or a pressure sensitive resistor, in which the resistor value is changed by depression, can be combined with EL sheet 16 to effect the advantage of the present invention. These combinations produce various switches, and thus various electrical signals can be generated.

Light-transmissible electrode layer 13A is formed by printing light-transmissible resin in which conductive particles are dispersed. Instead of this method, a light-transmissible electrode layer may be once formed beneath the entire insulating film 1 by a spattering or an electron beam method, and then the light-transmissible electrode layer can be formed at a given place by etching.

The present invention relates to an EL sheet employed as a back light in an operating section of various electronic apparatuses, and a switch employing the EL sheet. The EL sheet can be processed easily and can generate a stable click feel and can provide a switch employing the EL sheet.

What is claimed is:

1. An EL sheet comprising:

a light-transmissible insulating film including a flat section and a domed diaphragm protruding upward;

a plurality of EL element layers located beneath said flat section and said domed diaphragm, respectively, each of said plurality of EL element layers including:

a light-transmissible electrode layer disposed beneath said insulating film except at a bent section and its vicinity around a root section of said diaphragm;

a luminous layer disposed beneath said light-transmissible electrode layer;

a dielectric layer disposed beneath said luminous layer; and a back electrode layer disposed beneath said dielectric layer;

a first conductive pattern coupled to said light-transmissible electrode layer and disposed beneath said insulating film; and a second conductive pattern coupled to said back electrode layer and disposed beneath said insulating film.

2. The EL sheet of claim 1, wherein said light-transmissible electrode layer includes a light-transmissible resin and conductive particles dispersed in said light-transmissible resin.

3. The EL sheet of claim 1, wherein said first conductive pattern is unitarily formed with said light-transmissible electrode layer.

4. The EL sheet of claim 1, wherein said second conductive pattern is unitarily formed with said back electrode layer.

5. The EL sheet of claim 1, wherein at least one of said first and second conductive patterns is disposed at said bent section around said root section of said diaphragm.

6. The EL sheet of claim 1, wherein said first and second conductive patterns are disposed except said bent section and its vicinity around said root section of said diaphragm.

7. The EL sheet of claim 1, further comprising a movable contact disposed beneath one of said plurality of EL element layers.

8. The EL sheet of claim 1, further comprising a movable contact disposed beneath said diaphragm.

9. A switch comprising:

an EL sheet including:

a light-transmissible insulating film including a flat section and a domed diaphragm protruding upward;

a plurality of EL element layers disposed beneath said flat section and said diaphragm of said light-transmissible insulating film, respectively, each of said plurality of EL element layers including:

a light-transmissible electrode layer disposed beneath said insulating film except at a bent section and its vicinity around a root section of said diaphragm;

a luminous layer disposed beneath said light-transmissible electrode layer;

a dielectric layer disposed beneath said luminous layer; and a back electrode layer disposed beneath said dielectric layer;

a first conductive pattern coupled to said light-transmissible electrode layer and disposed beneath said insulating film;

a second conductive pattern coupled to said back electrode layer and disposed beneath said insulating film; and a movable contact disposed beneath said EL element layer;

a fixed contact facing said movable contact via a given clearance and disposed under said movable contact; and a circuit board including said fixed contact.

10. A switch comprising:

an EL sheet including:

a light-transmissible insulating film including a flat section and a domed diaphragm protruding upward;

a plurality of EL element layers located beneath said flat section and said diaphragm of said light-transmissible insulating film, respectively, each of said plurality of EL element layers including:

a light-transmissible electrode layer disposed beneath said insulating film except at a bent section and its vicinity around a root section of said diaphragm;

a luminous layer disposed beneath said light-transmissible electrode layer;

a dielectric layer disposed beneath said luminous layer; and a back electrode layer disposed beneath said dielectric layer;

a first conductive pattern coupled to said light-transmissible electrode layer and disposed beneath said insulating film; and a second conductive pattern coupled to said back electrode layer and disposed beneath said insulating film; and switch contacts disposed under said diaphragm, for being turned on and off by depression.

* * * * *